US008547301B2

(12) United States Patent
Kim

(10) Patent No.: US 8,547,301 B2
(45) Date of Patent: Oct. 1, 2013

(54) LIGHT EMITTING DISPLAY APPARATUS AND DRIVING METHOD THEREOF

(75) Inventor: Hyeong Gwon Kim, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 896 days.

(21) Appl. No.: 11/388,946

(22) Filed: Mar. 24, 2006

(65) Prior Publication Data

US 2006/0244389 A1 Nov. 2, 2006

(30) Foreign Application Priority Data

Apr. 28, 2005 (KR) ..... 10-2005-35779

(51) Int. Cl.
*G09G 3/30* (2006.01)

(52) U.S. Cl.
USPC ..... 345/76; 345/82

(58) Field of Classification Search
USPC ..... 345/204–215, 690–699, 87–111, 345/76–77, 82–83; 315/169.3
See application file for complete search history.

(56) References Cited

U.S. PATENT DOCUMENTS

| | | | | |
|---|---|---|---|---|
| 5,283,477 | A * | 2/1994 | Shibata | 327/306 |
| 2003/0020413 | A1 | 1/2003 | Oomura | |
| 2003/0030603 | A1 | 2/2003 | Shimoda | |
| 2003/0067424 | A1* | 4/2003 | Akimoto et al. | 345/55 |
| 2003/0193459 | A1* | 10/2003 | Kim et al. | 345/87 |
| 2003/0218583 | A1* | 11/2003 | Hasagawa | 345/76 |
| 2004/0155844 | A1 | 8/2004 | Stopa | |
| 2004/0160168 | A1* | 8/2004 | Lee et al. | 313/500 |
| 2004/0201556 | A1* | 10/2004 | Oomori et al. | 345/76 |
| 2004/0222954 | A1 | 11/2004 | Lueder | |
| 2004/0263442 | A1* | 12/2004 | Shingai et al. | 345/76 |
| 2005/0052350 | A1 | 3/2005 | Mizukoshi et al. | |
| 2005/0068270 | A1* | 3/2005 | Awakura et al. | 345/76 |
| 2006/0007220 | A1* | 1/2006 | Perner | 345/207 |

FOREIGN PATENT DOCUMENTS

| | | |
|---|---|---|
| KR | 10-1999-0066443 | 8/1999 |
| KR | 2001-0053303 | 10/1999 |
| KR | 2000-0010923 | 2/2000 |
| KR | 10-2004-0080629 | 9/2004 |

OTHER PUBLICATIONS

Office Action dated May 9, 2011 for U.S. Appl. No. 12/423,692, filed Apr. 14, 2009, which corresponds to captioned U.S. Appl. No. 11/388,946.

(Continued)

*Primary Examiner* — Chanh Nguyen
*Assistant Examiner* — Long D Pham
(74) *Attorney, Agent, or Firm* — Knobbe, Martens, Olson & Bear LLP

(57) ABSTRACT

A light emitting display apparatus, capable of protecting light emitting elements by preventing overcurrent from flowing into the elements, and a method of driving the light emitting display apparatus are disclosed. In one embodiment, the light emitting display apparatus comprises a pixel portion comprising a plurality of pixels for emitting light in response to a data signal and a scan signal, a data driver for generating and transmitting the data signal to the pixel portion; a scan driver for generating and transmitting the scan signal to the pixel portion, a timing controller for controlling the data driver and the scan driver, and a controller for detecting a current flowing through each of the pixels and blocking light emission of the pixel portion in case that the detected current is greater than a predetermined value.

8 Claims, 4 Drawing Sheets

(56) References Cited

OTHER PUBLICATIONS

Office Action dated Oct. 26, 2011 for U.S. Appl. No. 12/423,692, filed Apr. 14, 2009, which corresponds to captioned U.S. Appl. No. 11/388,946.

Office Action dated Apr. 19, 2012 for U.S. Appl. No. 12/423,692, filed Apr. 14, 2009, which corresponds to captioned U.S. Appl. No. 11/388,946.

Office Action dated Sep. 21, 2012 for U.S. Appl. No. 12/423,692, filed Apr. 14, 2009, which claims priority from captioned U.S. Appl. No. 11/388,946.

Notice of Allowance dated Jun. 10, 2013 for U.S. Appl. No. 12/423,692, filed Apr. 14, 2009, which claims priority from captioned U.S. Appl. No. 11/388,946.

* cited by examiner

LIGHT EMITTING DISPLAY APPARATUS AND DRIVING METHOD THEREOF

CROSS-REFERENCE TO RELATED APPLICATIONS

This application claims the benefit of Korean Patent Application No. 2005-35779, filed on Apr. 28, 2005, in the Korean Intellectual Property Office, the disclosure of which is incorporated herein by reference.

BACKGROUND

1. Field of the Invention

The present invention relates to a light emitting display apparatus and a driving method thereof, and more particularly, to a light emitting display apparatus, capable of reducing pixel deterioration overcurrent by preventing over current, and a driving method thereof.

2. Discussion of Related Technology

Various flat panel displays, which are relatively lighter and smaller than a cathode ray tube (CRT) display, have recently been developed. Among the flat panel displays, a light emitting display having an excellent viewing angle, fast speed response, high definition, a thin structure, and the like is desired.

Such desirable properties can be found in a light emitting display comprising an organic light emitting display (OLED) which uses an organic light emitting element, and an inorganic light emitting display which uses an inorganic light emitting element. The organic light emitting element is also called an organic light emitting diode (OLED). An OLED comprises an organic light emitting layer disposed between an anode electrode and a cathode electrode for emitting light. The inorganic light emitting element is also called a light emitting diode (LED). A LED comprises a light emitting diode formed of an inorganic material, for example, a semiconductor with p-n junction different from the organic light emitting diode.

FIG. 1 illustrates a circuit diagram of a pixel employed in a typical light emitting display apparatus. Referring to FIG. 1, a pixel comprises a pixel circuit, an OLED, a first transistor M1, a second transistor M2, and a capacitor Cst. Each of the first and second transistors is implemented by a PMOS transistor and is composed of a source, a drain and a gate. Since the source and the drain are physically identical, they can be just called a first electrode and a second electrode or vice versa. The capacitor Cst comprises a first terminal and a second terminal.

The first transistor M1 has the source connected to a first power line ELVdd, a drain connected to the OLED and a gate connected to a first node N1. Accordingly, a current flows from the source to the drain in response to a voltage at the first node N1.

The second transistor M2 has the source connected to a data line Dm, a drain connected to the first node N1 and a gate connected to a scan line Sn, so that the second transistor M2 selectively transfers a data signal flowing through the data line Dm to the first node N1 depending on a scan signal transmitted via the scan line Sn.

The capacitor Cst is comprised of a first terminal connected to the first power line ELVdd and a second terminal connected to the first node N1, thereby maintaining a voltage between the gate and the source of the first transistor M1 for a predetermined time. The voltage stored in the capacitor Cst is computed by the following equation:

$$Vgs = ELVdd - Vdata \quad \text{Equation (1)}$$

Here, Vgs is a gate-to-source voltage of the first transistor M1, ELVdd is a voltage of the first power line and Vdata is a voltage of the data signal.

Further, a current flowing across the OLED is computed by the following equation:

$$I_{OLED} = \frac{\beta}{2}(Vgs - Vth)^2 = \frac{\beta}{2}(ELVdd - Vdata - Vth)^2 \quad \text{Equation (2)}$$

Here, $I_{OLED}$ is a current flowing through the OLED, Vgs is a gate-to-source voltage of the first transistor M1, ELVdd is a voltage of the first power line, Vdata is a voltage of the data signal and Vth is a threshold voltage of the first transistor M1.

Accordingly, a light emitting device comprising the pixel as illustrated in FIG. 1 emits light by making current flow through the OLED.

However, if overcurrent, i.e., current exceeding the maximum rated current for the device, flows across the OLED for a long time, it causes damage to the OLED, so that the element continues to deteriorate and finally cannot emit light.

SUMMARY OF CERTAIN INVENTIVE ASPECTS

Accordingly, it is an aspect of the present invention to provide a light emitting display apparatus and a driving method thereof, capable of preventing overcurrent from flowing through a light emitting element, thereby preventing the light emitting element from being damaged.

One aspect of the present invention provides a light emitting display apparatus comprising a pixel portion being composed of a plurality of pixels and emitting light in response to a data signal and a scan signal, a data driver for generating and transmitting a data signal to the pixel portion, a scan driver for generating and transmitting a scan signal to the pixel portion, a timing controller for controlling the data driver and the scan driver, and a controller for checking currents flowing through the plurality of pixels and blocking current flow to the pixel portion in case that a peak current is greater than a predetermined value.

Another aspect of the present invention provides a light emitting display apparatus comprising a pixel portion being composed of a plurality of pixels and emitting light in response to a data signal and a scan signal, a data driver for generating and transmitting a data signal to the pixel portion, a scan driver for generating and transmitting a scan signal to the pixel portion, a timing controller for controlling the data driver and the scan driver, and a controller for checking the currents flowing through the pixels and intercepting video data to be supplied to the timing controller in case a value obtained by adding currents flowing through at least two pixels is greater than a predetermined value.

Still another aspect of the present invention provides a method of driving a light emitting display apparatus comprising a plurality of pixels, the method comprising generating a voltage at least based on a data signal and intercepting the data signal in case the generated voltage is higher than a predetermined level.

BRIEF DESCRIPTION OF THE DRAWINGS

Embodiments of the invention will be described with reference to the attached drawings.

DETAILED DESCRIPTION OF CERTAIN INVENTIVE EMBODIMENTS

Hereinafter, certain embodiments of the present invention will be described with reference to the accompanying drawings.

Figure 1:
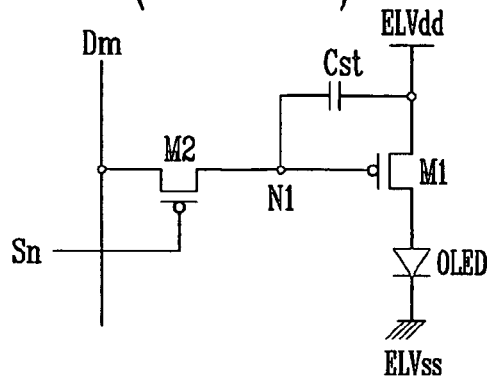
FIG. 1 (PRIOR ART)
FIG. 1 is a circuit diagram of a pixel provided in a conventional light emitting display apparatus.
Figure 2:
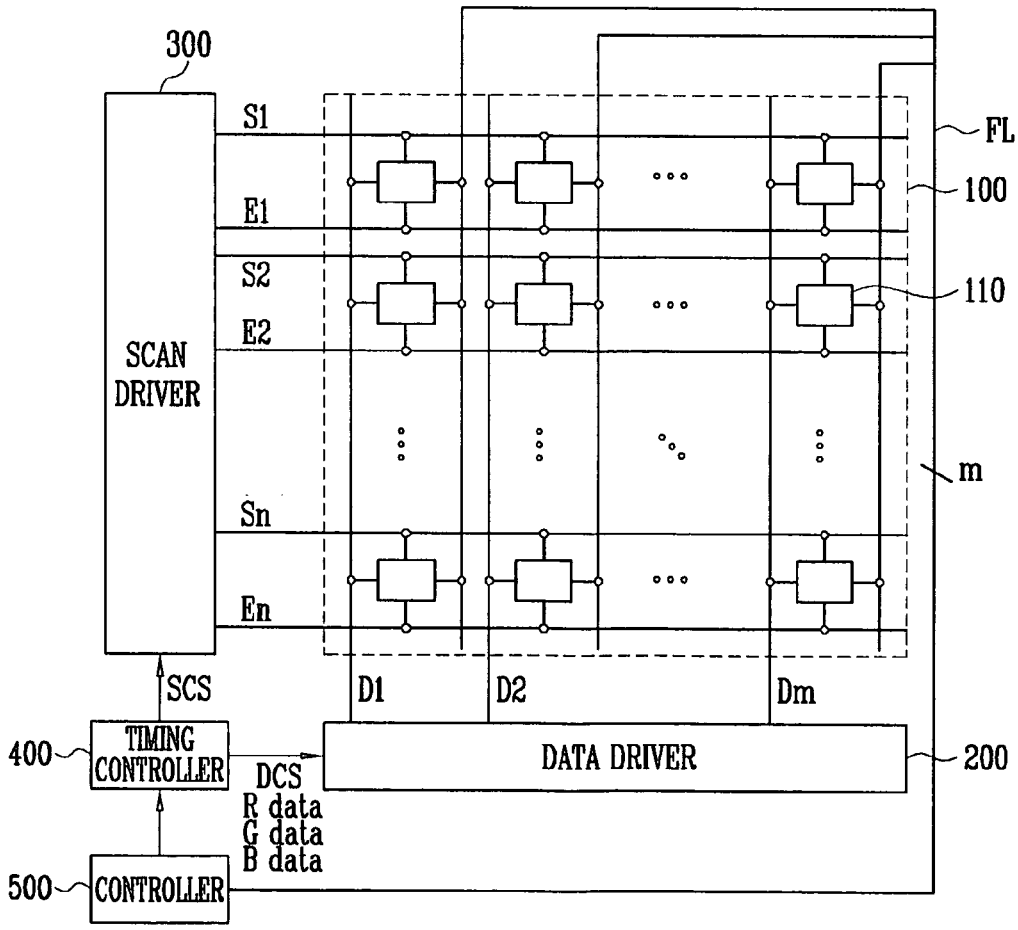
FIG. 2 illustrates an embodiment of a light emitting display apparatus comprising display pixels.

FIG. 2 illustrates an embodiment of a light emitting display apparatus comprising display pixels. Referring to FIG. 2, a light emitting display apparatus according to an embodiment of the present invention comprises a pixel portion 100, a data driver 200, a scan driver 300, a timing controller 400 and a controller 500.

The pixel portion 100 comprises a plurality of pixels 110 arranged therein and each pixel 110 is composed of a light emitting element (not shown) and a pixel circuit. The pixel portion further comprises n scan lines S1, S2, . . . Sn−1 and Sn arranged in a row direction to transfer scan signals, m data lines D1, D2 . . . Dm−1 and Dm arranged in a column direction to transfer data signals and m first power lines L1 to supply a first power signal. The light emitting element comprises a first electrode and a second electrode and emits light when a current flows between the first electrode and the second electrode. The pixel circuit is connected to the scan lines S1, S2 . . . Sn−1 and Sn, the data lines D1, D2 . . . Dm−1 and Dm, and the first power lines L1, generating a current in response to a scan signal, a data signal and a first power voltage ELVdd. The first electrode of the light emitting element is connected to the pixel circuit and the second electrode is connected to a second power voltage ELVss lower than the first power voltage ELVdd, so that the light emitting element causes a current to flow from the first electrode via the light emitting element into the second electrode and emits light.

The pixel portion 100 comprises a plurality of current detection lines FL connected to the pixels to detect currents flowing through the pixels and transfer the detected currents to the controller 500. The plurality of current detection lines FL are connected to all the pixels and the number of the current detection lines FL are identical to the number of the data lines.

The data driver 200 is configured to apply a data signal to the pixel portion 100. It receives a data control signal and R, G and B video data from the timing controller 400, generates a data signal and then transmits the data signal to the data lines D1, D2 . . . Dm−1 and Dm.

The scan driver 300 is configured to output scan signals sequentially. It generates a scan signal after receiving a scan control signal from the timing controller 400 and transmits the scan signal to the pixel portion 100 via the scan lines S1, S2 . . . Sn−1 and Sn.

The timing controller 400 sends the data control signal DCS and the R, G and B video data to the data driver 200, thereby controlling the operation of the data driver 200. Further, the timing controller 400 transmits the scan control signal SCS to the scan driver 300, thereby controlling the operation of the scan driver 300.

The controller 500 is connected to each pixel 110 in the pixel portion 100 to detect a current flowing through each pixel. In case the controller 500 detects overcurrent from any one of the plurality of pixels 110, the controller 500 intercepts the R, G and B video data to be input to the timing controller 400 so that the data signal can not be transmitted to the pixel portion 100, thereby preventing the pixels 110 from being damaged.

Figure 3:
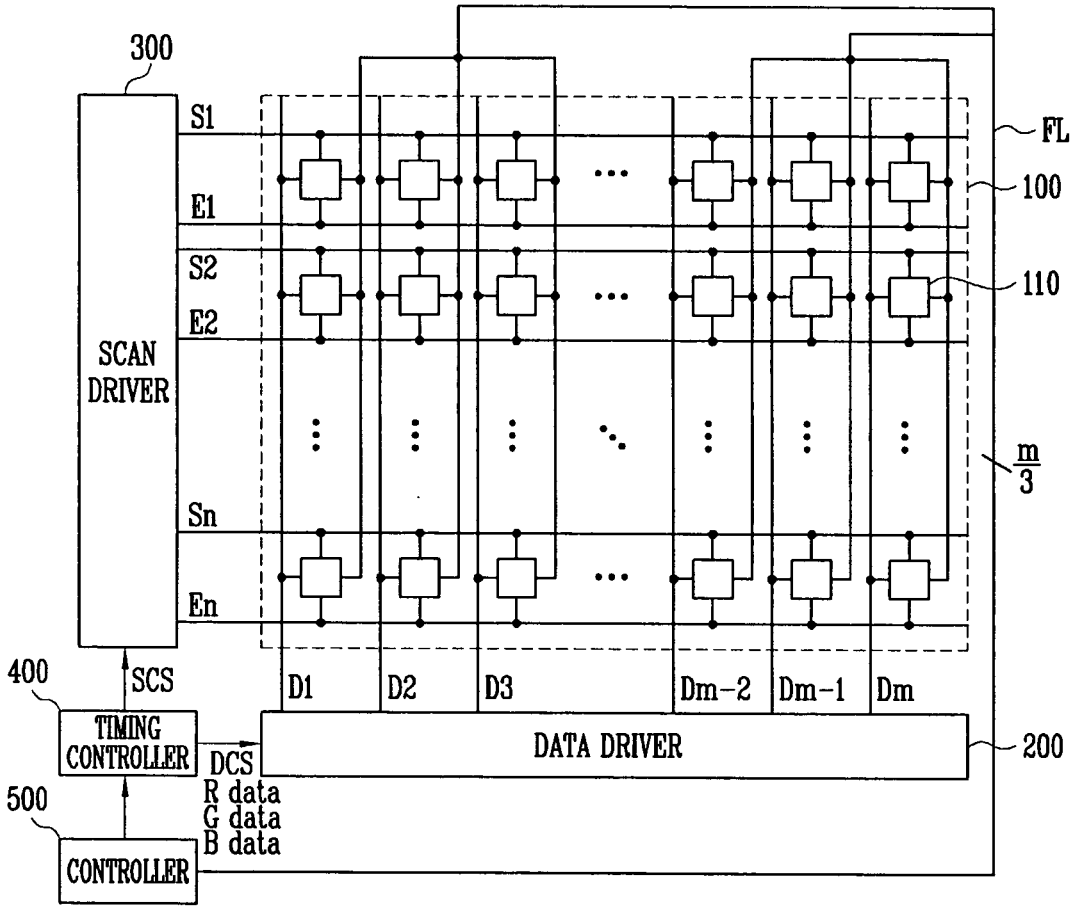
FIG. 3 illustrates another embodiment of a light emitting display apparatus.

FIG. 3 illustrates another embodiment of a light emitting display apparatus. Referring to FIG. 3, a light emitting display apparatus in accordance with the second embodiment comprises a pixel portion 100, a data driver 200, a scan driver 300, a timing controller 400, and a controller 500.

The pixel portion 100 comprises a plurality of pixels 110 arranged therein and each pixel 110 is composed of a light emitting element (not shown) and a pixel circuit. The pixel portion further comprises n scan lines S1, S2 . . . Sn−1 and Sn arranged in a row direction to transfer scan signals, m data lines D1, D2, . . . Dm−1 and Dm arranged in a column direction to transfer data signals and m first power lines L1 to supply a first power signal. The light emitting element comprises a first electrode and a second electrode and emits light when a current flows between the first electrode and the second electrode. The pixel circuit is connected to the scan lines S1, S2 . . . Sn−1 and Sn, the data lines D1, D2, . . . Dm−1 and Dm, and the first power line L1, generating a current in response to a scan signal, a data signal and a first power voltage ELVdd. The first electrode of the light emitting element is connected to the pixel circuit and the second electrode is connected to a second power voltage ELVss lower than the first power voltage ELVdd, so that the light emitting element causes a current flow from the first electrode via the light emitting element into the second electrode and emits light.

The pixel portion 100 comprises a plurality of current detection lines FL to detect currents flowing through the pixels and transfer the detected currents to the controller 500. Here, each of the plurality of current detection lines FL is connected to three pixels respectively displaying red, green and blue colors, so that the number of the current detection lines FL is reduced to ⅓ compared to the first embodiment. In other words, the number of the current detection lines FL is ⅓ of the number of data lines.

The data driver 200 is configured to apply a data signal to the pixel portion 100. It receives a data control signal and R, G and B video data from the timing controller 400, generates a data signal, and then transmits the data signal to the data lines D1, D2 . . . Dm−1 and Dm.

The scan driver 300 is configured to output scan signals sequentially. It generates a scan signal after receiving a scan control signal and transmits the scan signal to the pixel portion 100 via the scan lines S1, S2 . . . Sn−1 and Sn.

The timing controller 400 sends the data control signal DCS and the R, G and B video data to the data driver 200, thereby controlling the operation of the data driver 200. Further, the timing controller 400 transmits the scan control signal SCS to the scan driver 300, thereby controlling the operation of the scan driver 300.

The controller 500 detects the currents flowing through the red, green and blue pixels 110 and adds the detected currents. In case the sum of the currents is identical or greater than a predetermined value, the controller intercepts R, G and B video data to be input to the timing controller 400, thereby intercepting the data signal to be transferred to the pixel portion 100 and preventing the pixels 110 from being damaged by preventing overcurrent from flowing through the pixels 110.

Figure 4:
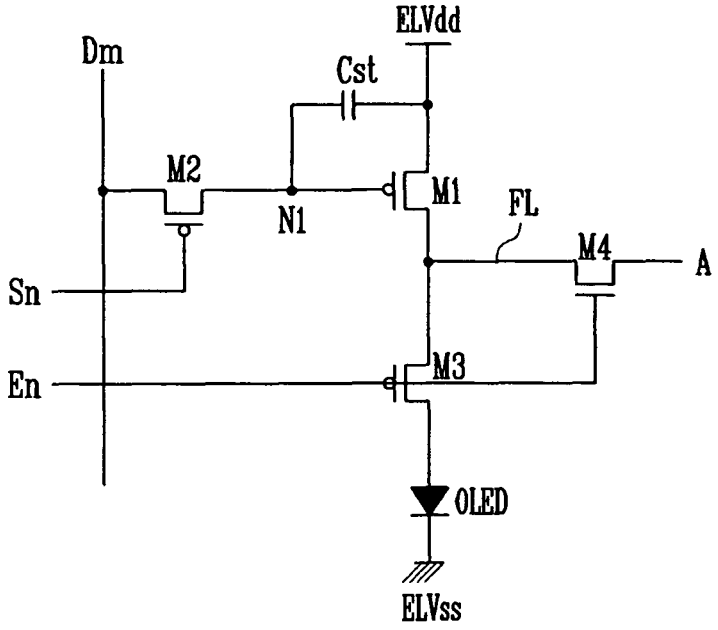
FIG. 4 is a circuit diagram of a pixel provided in the light emitting display apparatus shown in FIGS. 2 and 3.

FIG. 4 is a circuit diagram of a pixel employed in the light emitting display apparatus shown in FIGS. 2 and 3. Referring to FIG. 4, a pixel comprises a pixel circuit and an OLED. The pixel further comprises a first to a fourth transistors M1, M2, M3 and M4 and a capacitor Cst. Each of the first to the fourth transistors M1, M2, M3 and M4 comprises a source, a drain and a gate. Since the source and drain are implemented by the physically identical elements, the source and drain are also called a first electrode and a second electrode or vice versa. The capacitor Cst has a first terminal and a second terminal.

In the first transistor M1, the source is connected to a first power line ELVdd, the drain is connected to the third transistor M3, and the gate is connected to a first node N1. Accordingly, a current flows from the source to the drain of the first transistor M1 depending on a voltage at the node N1.

In the second transistor M2, the source is connected to the data line Dm, the drain is connected to the first node N1, and the gate is connected to the scan line Sn. Therefore, the second transistor M2 selectively transmits the data signal flowing through the data line Dm in response to the scan signal transmitted via the scan line Sn.

In the capacitor Cst, the first terminal is connected to the first power line ELVdd and the second terminal is connected to the first node N1. Therefore, the capacitor Cst maintains a voltage between the gate and the source of the first transistor M1.

In the third transistor M3, the source is connected to the drain of the first transistor M1, the drain is connected to the OLED, and the gate is connected to a light emitting control line En. Therefore, the third transistor M3 performs switching operations in response to a light emitting control signal and selectively transmits a current flowing through the first transistor M1 to the OLED.

In the fourth transistor M4, the source is connected to the drain of the first transistor M1, the drain is connected to a terminal A, and the gate is connected to the light emitting control line En. Therefore, the fourth transistor M4 transmits the current generated in the first transistor M1 to the terminal A in response to the light emitting control signal transmitted via the light emitting control line En. The third transistor M3 is implemented by a PMOS transistor and the fourth transistor M4 is implemented by an NMOS transistor so that when the third transistor M3 is on state, the fourth transistor M4 is off state. On the contrary, when the third transistor M3 is off state, the fourth transistor M4 is on state.

Figure 5:
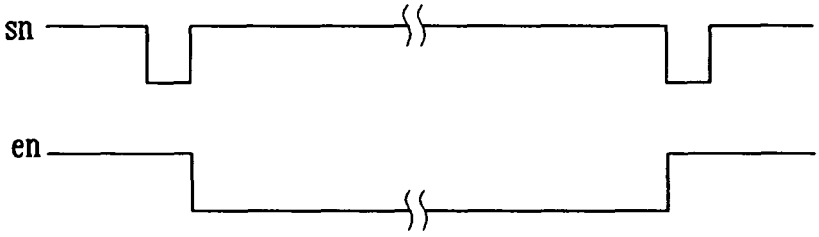
FIG. 5 is a waveform diagram of an embodiment of a signal to be input to the pixel shown in FIG. 4.

FIG. 5 illustrates a waveform diagram of an embodiment of a signal to be input to the pixel shown in FIG. 4. Referring to FIG. 5, a data signal (not shown), a scan signal sn and a light emitting control signal en are input to a pixel.

In the case where the scan signal sn is logic low and the light emitting control signal en is logic high, the second transistor M2 and the fourth transistor M4 are turned on but the third transistor M3 is turned off. Since the data signal is transferred to the first node N1 via the second transistor M2, the capacitor Cst stores a voltage corresponding to the data signal. Accordingly, the first transistor M1 generates a current corresponding to the data signal, and the generated current is transferred to the terminal A via the fourth transistor M4, and then supplied to the controller 500. The controller 500 then determines whether or not the generated current is overcurrent by detecting the supplied current.

In the case where the scan signal sn is logic high and the light emitting control signal en is logic low, the second transistor M2 and the fourth transistor M4 are turned off and the third transistor M3 is turned on. Since the fourth transistor M4 is turned off, a current path from the first transistor M1 to the controller 500 is blocked. Accordingly, the capacitor Cst stores a voltage corresponding to the data signal, so that the gate voltage of the first transistor M1, which corresponds to the data signal, is maintained. That is, a voltage corresponding to the data signal is maintained and thus the first transistor M1 continuously generates a current corresponding to the data signal. Further, since the third transistor M3 is turned on, the current generated by the first transistor M1 can flow into the OLED.

Consequently, the current generated by the first transistor M1 only flows into the OLED so that the OLED is supplied with the current corresponding to the data signal.

Figure 6:
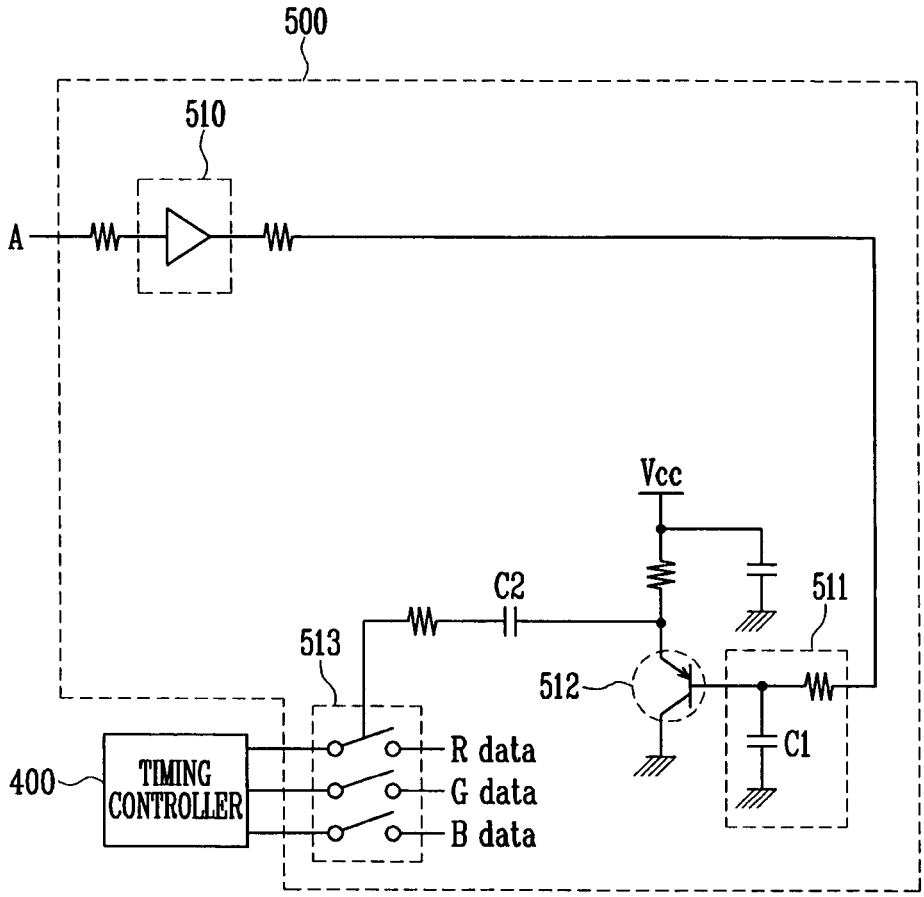
FIG. 6 is an illustration of one embodiment of a connection structure connecting a controller with a timing controller in the light emitting display apparatus shown in FIGS. 2 and 3.

FIG. 6 illustrates one embodiment of a connection structure connecting a controller with a timing controller in the light emitting display apparatus shown in FIG. 2 and FIG. 3. Referring to FIG. 6, the controller 500 comprises a current-to-voltage converter 510, a filter 511, a transistor 512 and a switching portion 513. The switching portion 513 is connected to the timing controller 400, thereby controlling whether a signal is to be input to the timing controller 400 or not.

The current-to-voltage converter 510 is connected to a terminal A of a pixel, thereby converting a current transmitted from the terminal A to a predetermined voltage. The current-to-voltage converter 510 can be implemented by, for example, an amplifier.

The filter 511 is a low pass filter composed of a resistor and a capacitor C1, thereby eliminating the high frequency component in a voltage output from the current-to-voltage converter 510.

The transistor 512 is implemented by a bipolar transistor and operates depending on a voltage output from the filter 511. That is, the transistor 512 is turned on in response to the voltage output from the filter 511, thereby transferring a first voltage Vcc to the switching portion 513.

A collector of the transistor 512 is connected to a capacitor C2 to generate a switching signal by coupling operation of the capacitor, and transmits the switching signal to the switching portion 513. The capacitor C2 repeatedly performs charge and discharge operations in response to the voltages output from the transistor 512 which is alternately turned on and off, thereby generating a control signal alternately representing logic high and logic low and transmitting such control signal to the switching portion 513.

The switching portion 513 performs the switching on and off operations in response to the control signal generated by the transistor 512 and the capacitor C2, thereby selectively allowing video data to be transmitted to the timing controller 400. Accordingly, in case that overcurrent flows into the OLED, the switching portion intercepts the video data, thereby intercepting the data signal to be sent to the pixel and preventing the pixel from being damaged.

As can be seem from the foregoing discussion, embodiments of a light emitting display apparatus and the method of driving the same are capable of preventing a pixel from being damaged by over current, by intercepting the video data that may produce overcurrent and therefore preventing overcurrent flowing into the pixel.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The scope of the invention is indicated by the appended claims rather than by the foregoing description. All changes which come within the meaning and range of equivalency of the claims are to be embraced within their scope.

What is claimed is:

1. A light emitting display apparatus comprising:

a data controller;

a pixel portion comprising a plurality of pixels, wherein each pixel comprises:

a light emitting element configured to emit light according to a current provided thereto, and a pixel circuit configured to receive a data signal and a scan signal and to generate the current for the light emitting element, and to either conduct the current to the light emitting element or to divert the current through a switch to the data controller based on the data and scan signals;

a data driver configured to transmit the data signal to the pixel portion;

a scan driver configured to transmit the scan signal to the pixel portion; and a timing controller configured to selectively receive video data and to control the data driver and the scan driver, wherein the data controller is configured to receive the diverted current from each of the pixels and to determine whether the diverted current is greater than a predetermined value in any one of the pixels, wherein the data controller is further configured to control a switching portion so as to prevent the video data from being transmitted to the timing controller if the diverted current is greater than the predetermined value, wherein the data controller further comprises:

a current-to-voltage converter configured to convert the diverted current flowing from the pixel to a voltage;

a low pass filter which is connected to an output terminal of the current-to-voltage converter;

a transistor which is connected to an output terminal of the low pass filter so that the transistor is turned off and on in response to an output signal of the low pass filter;

a capacitor configured to generate a switching signal based on voltages received from the transistor which changes according to the off and on status of the transistor; and the switching portion configured to be turned on and off in response to the switching signal output from the capacitor for preventing the video data from being sent to the timing controller through switching operations.

2. The light emitting display apparatus according to claim 1, wherein the data controller is configured to intercept the data signal by preventing power from being supplied to any one of the pixel portion, the data driver, the scan driver and the timing controller.

3. The light emitting display apparatus according to claim 1, wherein the data controller is configured to intercept the data signal by preventing video data from being supplied to the timing controller.

4. The light emitting display apparatus according to claim 1, wherein the current-to-voltage converter further comprises an amplifier.

5. A method of driving a light emitting display apparatus comprising a plurality of pixels, wherein each pixel comprises a light emitting element configured to emit light according to a current provided thereto, and a pixel circuit configured to receive a data signal and a scan signal and to generate the current for the light emitting element based on the data and scan signals, the method comprising:

generating the data signal based on received video data;

displaying an image based on the data signal;

conducting the current to the light emitting element of the pixel or diverting the current from the light emitting element of the pixel through a switch;

receiving the diverted current and determining whether the diverted current from each of the pixels is greater than a predetermined value;

controlling a switching portion configured to selectively transmit the video data to the pixels according to whether the diverted current is greater than the predetermined value, wherein if the diverted current is greater than the predetermined value, the video data is not transmitted to the pixels, wherein the method of controlling the switching portion comprises:

converting the diverted current flowing from the pixel to a voltage by a current-to-voltage converter;

filtering the voltage output from the current-to-voltage converter by a low pass filter;

turning off and on of a transistor in response to an output signal from the low pass filter;

generating a switching signal from a capacitor based on voltages received from the transistor which changes according to the off and on status of the transistor; and turning on and off of the switching portion in response to the switching signal output from the capacitor for preventing the video data from being sent to the pixels through switching operations.

6. The method according to claim 5, wherein the current-to-voltage converter generates the voltage from a current flowing through the pixel.

7. The method according to claim 5, wherein the current-to-voltage converter generates the voltage by adding currents flowing through at least two pixels.

8. A light emitting display apparatus comprising:

a plurality of means for emitting light;

means for generating current for the light emitting means according to a data signal and a scan signal;

means for generating the data signal based on received video data;

means for generating the scan signal;

means for controlling data generating means and the scan generating means;

means for diverting the generated current from the light emitting means;

means for receiving the diverted current;

means for determining whether the diverted current is greater than a predetermined value; and means for controlling a switching portion according to whether the diverted current is greater than the predetermined value, wherein if the diverted current is greater than the predetermined value, the video data is not transmitted to the means for emitting light, wherein the means for controlling the switching portion comprises:

means for converting the diverted current flowing from the means for emitting light to a voltage;

means for filtering the voltage output from the means for converting;

means for turning off and on in response to an output signal from the means for filtering;

means for generating a switching signal based on voltages received from the means for turning off and on which changes according to the off and on status of the means for turning off and on; and the switching portion configured to be turned on and off in response to the switching signal for preventing the video data from being sent to the means for emitting light through switching operations.

* * * * *